US005372362A

United States Patent [19]

Barker

[11] Patent Number: 5,372,362

[45] Date of Patent: Dec. 13, 1994

[54] GOLF ACCESSORY DEVICE

[75] Inventor: Thomas G. Barker, Wakefield, Mass.

[73] Assignee: Paul K. Guillow, Inc., Wakefield, Mass.

[21] Appl. No.: 91,201

[22] Filed: Jul. 14, 1993

[51] Int. Cl.[5] ..... A63B 57/00

[52] U.S. Cl. ..... 273/32 A; 224/918

[58] Field of Search ..... 273/33, 32 A, 32 D, 273/32 B; 224/918

[56] References Cited

U.S. PATENT DOCUMENTS

| | | | |
|---|---|---|---|
| 2,560,414 | 7/1951 | Cheney | 224/918 |
| 3,272,412 | 9/1966 | Antonious | 224/918 |
| 3,799,331 | 3/1974 | White | 224/918 |
| 4,730,728 | 3/1988 | Larkin | 224/918 |

FOREIGN PATENT DOCUMENTS

| | | | |
|---|---|---|---|
| 2220364 | 1/1990 | United Kingdom | 273/33 |

*Primary Examiner*—Mark S. Graham

*Attorney, Agent, or Firm*—Watson, Cole, Grindle & Watson

[57] ABSTRACT

An integral one-piece construction includes a rigid flat body having a face with indicia thereon. Golf tees have their pointed ends breakably connected to the body to be broken off and supported in holes in the body. The tees have shoulders thereon and protuberances on the shanks to hold the tees in place in the associated holes. The tees have ball supporting ends spaced at different distances from the shoulders to support golf balls at different heights above the ground. Golf ball markers are breakably connected to the body and have stems which fit in holes in the body to support the markers on the body after it is broken off. A turf repair tool is breakably connected to the body and has stems which fit in holes in the body to support the tool on the body after it is broken off. A slot is formed through the body for receiving a strap to connect the device to a golf bag.

9 Claims, 1 Drawing Sheet

Fig. 1.
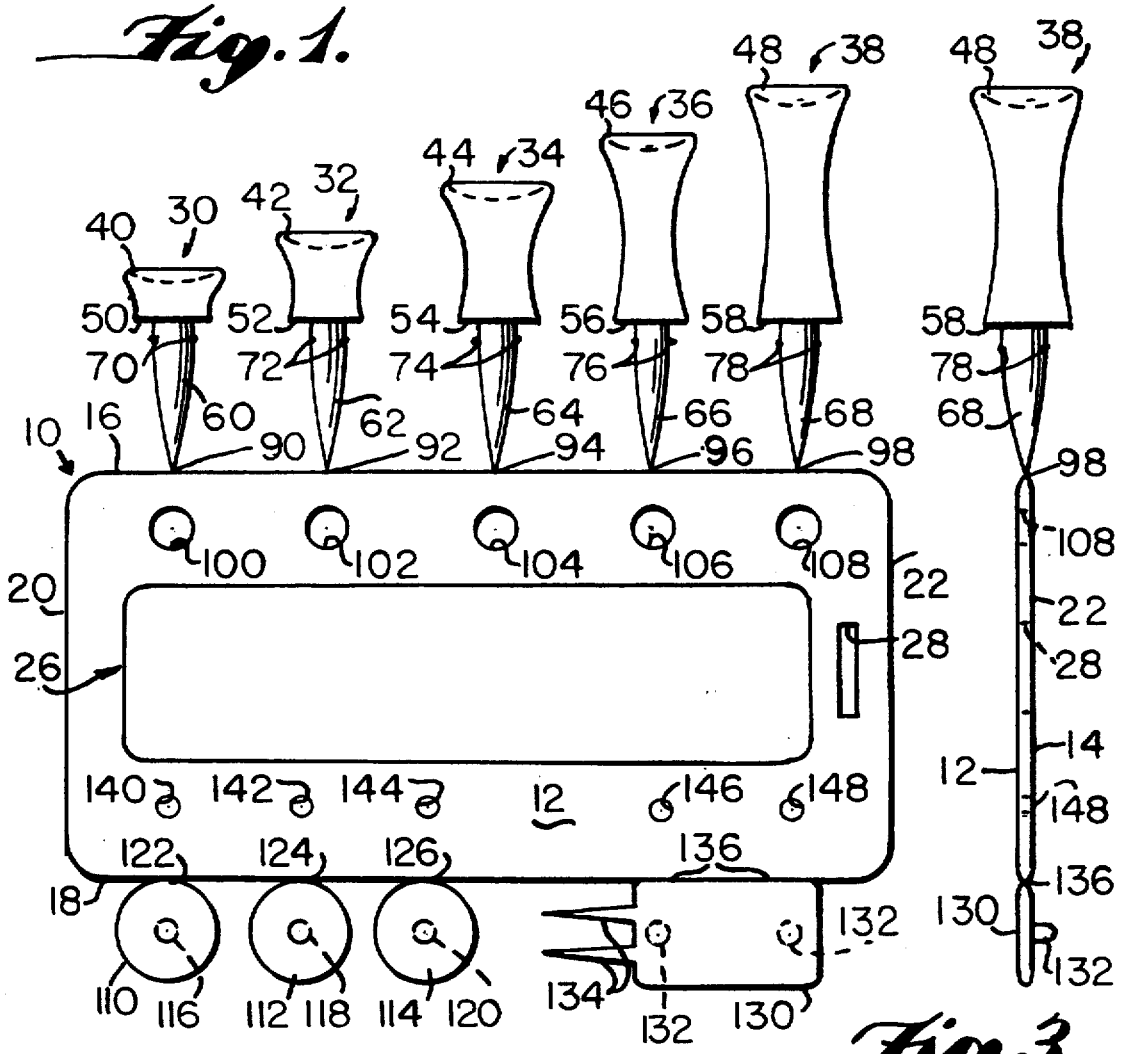
Fig. 3.
Fig. 2.
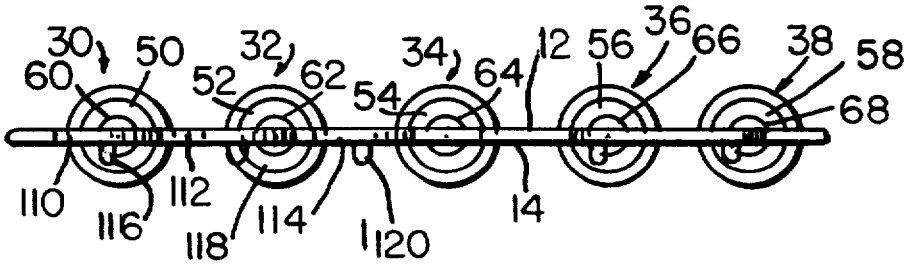

GOLF ACCESSORY DEVICE

BACKGROUND OF THE INVENTION

The present invention relates to a golf accessory device which is adapted to serve as an advertisement for a particular business or service and which is sufficiently inexpensive that it can be given away to their customers. The device has a relatively large area thereon adapted to carry indicia which may be of any suitable nature so as to advertise a business or service to a person viewing the device. The device is designed to be attached to a golf bag and to support various golf accessories such as tees, golf ball markers and a turf repair tool used for repairing divots caused by golf balls. These accessories should be readily available to golfer when playing golf, and accordingly, the golfer will normally mount a device of this type at the top of his golf bag where it will prominently display the advertising thereon.

Prior art devices have been provided for supporting golf accessories, although many of such devices are adapted to be supported by the clothing of the golfer rather than a golf bag. Devices supported by the clothing of the golfer have not proved to be very popular. It is accordingly desirable to provide an advertising device which can be supported on a golf bag and which is inexpensive to manufacture, but which will have great utility in supporting the desired golf accessories in a position where they are readily accessible to the golfer when needed. Furthermore, it is important that the golf accessories be securely supported on the device so that they do not fall off and become lost, since golf bags are sometimes handled in a rough manner.

SUMMARY OF THE INVENTION

The invention provides an integral one-piece construction which can be injection molded to provide a device of minimal cost so that it can readily serve as a give-away item. The device includes a body having a large area which has indicia thereon to provide the desired message. The device includes golf tees, golf ball markers and a turf repair tool, all of which can be readily manually disconnected from the body. In addition, the body includes integral support means in the form of holes formed therein which are adapted to securely support the golf accessories in position and which permits each golf accessory to be easily removed for use and subsequently replaced in supported position on the body. The device is formed of a suitable plastic material so that the various golf accessories are not broken during normal use and can be used over and over again.

BRIEF DESCRIPTION OF THE DRAWINGS

FIG. 1 is a plan view of a device according to the invention;

FIG. 2 is a front view of the device shown in FIG. 1; and

FIG. 3 is a side view of the device shown in FIG. 1.

DESCRIPTION OF THE PREFERRED EMBODIMENT

Referring now to the drawings wherein like reference characters designate corresponding parts throughout the several views, the device is an integral one-piece injection molding preferably formed of high impact polystyrene plastic which enables economical manufacture and which provides sufficient strength to the body and golf accessories so that they will not break during normal use.

The device includes a flattened body 10 including opposite parallel flat faces 12 and 14 which as seen in FIG. 1 are joined by upper and lower edge surfaces 16 and 18 as well as end edge surfaces 20 and 22. The body includes a central imprint area 26 which has suitable indicia thereon. This imprint area may be disposed only on face 12 or a similar imprint area may also be disposed on face 14. The imprint area may receive a paper label adhesively secured in position, or the indicia may applied, for example, by a silk screen method or by hot stamping. An elongated slot 28 is formed in the body 10 for receiving a strap for connecting the device to a golf bag.

A plurality of tees 30, 32, 34, 36 and 38 extend laterally away from upper edge surface 16, the tees having golf ball supporting ends 40, 42, 44, 46 and 48 and shoulders 50, 52, 54, 56 and 58 thereon respectively. It is apparent that the shoulders will limit the movement of the tees into the ground. The tees also include shank portions 60, 62, 64, 66 and 68 of substantially the same length and each of which has a pair of diametrically opposite protuberances 70, 72, 74, 76, and 78 thereon respectively for a purpose hereinafter described. The shank portions taper to a point adjacent the upper edge surface 16 of body 10 and these pointed ends of the tees are connected to edge surface 16 by frangible portions 90, 92, 94, 96 and 98 respectively. This permits the tees to be manually disconnected from the body.

It should be noted that the distances between the shoulder and the ball supporting end of the tees is progressively greater in tees 30, 32, 34, 36 and 38. Accordingly, when the tees are inserted into the ground until the the shoulders thereon engage the ground, a golf ball will be supported at different heights above the ground depending on which tee is used. This is advantageous since it is desirable to support a golf ball at different heights depending on which golf club is used.

A plurality of holes 100, 102, 104, 106 and 108 are formed in the body 10 for receiving the shanks of the disconnected tees. The diameter of the holes is such that the upper ends of the shank portions on the tees is snugly received within the holes, but since the shank portions are tapered, the holes may not retain the tees in position on the body. Accordingly, the small protuberances formed at diametrically opposite portions on the shank portions are adapted to hold the tees securely in position. For example, if the tees are inserted through the holes from face 12 toward face 14, the distance between the protuberances and the associated shoulders on the tees is substantially the same as the thickness of body 10 so that the protuberances will snap into place beyond face 14 to hold the tees in place. The tees can be readily removed and subsequently replaced when desired due to the inherent flexibility of the material of the body 10 and the tees.

Three ball markers 110, 112 and 114 extend laterally outwardly from lower side edge 18 of the body 10, each of these ball markers including a disc portion having stems 116, 118 and 120 centrally located thereon and extending at right angles thereto as is conventional. The ball markers are connected to the edge surface 18 of body 10 by frangible portions 122, 124 and 126 which permit the markers to be readily manually disconnected from the body.

A turf repair tool 130 extends laterally outwardly from lower side edge 18 and includes a flat body and has a pair of stems 132 extending at right angles thereto. The tool also has a pair of tapered prongs 134 extending from one side edge thereof as is conventional. The tool is connected to the edge surface 18 of the body 10 by frangible portions 136 which permit the tool to be readily manually disconnected from the body.

Three holes 140, 142 and 144 are provided in the body and are adapted to snugly receive stems 116, 118 and 120 respectively of the disconnected markers to support the markers on the body. Two additional holes 146 and 148 are provided in the body and are adapted to snugly receive stems 132 to support the disconnected tool on the body. It is apparent that the markers and tool may be readily removed and then subsequently replaced in supported position when desired.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A golf accessory device comprising, an integral one-piece construction including a body having indicia thereon, a plurality of spaced golf accessories extending outwardly away from said body, each of said golf accessories being connected to said body by frangible connecting means so that all of the golf accessories may be manually disconnected from said body, said body including integral support means for detachably supporting said golf accessories on said body after the golf accessories have been disconnected from said body, said integral support means comprising plurality of spaced holes formed in said body for receiving portions of said golf accessories therein, said golf accessories including a plurality of golf tees having shank portions thereon, said shank portions being adapted to be received in said holes, each of said tees having a shank portion of substantially the same length, each shank portion having opposite ends, a first tapered end portion terminating in a pointed end, each shank portion terminating at its opposite end at a shoulder formed on said tee, each of said tees having a golf ball supporting end spaced from the shoulder formed thereon, the distance between the shoulder and the ball supporting end of the tees varying progressively so that when different tees are inserted into the ground with the shoulders thereon engaging the ground, golf balls supported by the tees will be at different heights above the ground.

2. A golf accessory device comprising, an integral one-piece construction including a rigid flattened body having a thickness and having opposite faces joined by side edge means, at least one of said faces having indicia thereon, a plurality of spaced golf accessories extending laterally away from said side edge means, each of said golf accessories being connected to said side edge means by frangible connecting means so that all of the golf accessories may be manually disconnected from said body, said body having a plurality of holes formed therethrough, each of said holes opening at said opposite faces, each of said golf accessories having an integral portion which is adapted to be received within one of said holes for supporting the golf accessory on the body after the golf accessory is manually disconnected from the side edge means of the body, at least some of said golf accessories comprising golf tees having shank portions thereon which are adapted to be received within said holes, protuberance means formed on said shank portions and extending laterally from said shank portions of the golf tees for engaging said body and retaining the golf tees in place on said body.

3. A device as defined in claim 2 wherein said protuberance means includes a plurality of spaced laterally extending protuberances formed on each of said shank portions.

4. A device as defined in claim 2 wherein said protuberance means is adapted to engage one face of said body, and the associated golf tees have a surface formed thereon adapted to engage the opposite face of said body.

5. A device as defined in claim 2 wherein each shank portion has opposite ends, a first end of each shank portion being tapered and terminating in a pointed end, each shank portion terminating at its opposite end at a shoulder, the distance between said shoulder and said protuberance means on each of said shank portions being substantially the same as said thickness of the body.

6. A device as defined in claim 5 wherein said opposite end of each of said shank portions fits snugly within one of said holes.

7. A device as defined in claim 2 wherein said golf accessories include a plurality of golf ball markers, each of said markers having a stem extending therefrom, said stems being adapted to fit snugly within said holes.

8. A device as defined in claim 2 wherein said golf accessories include a turf repair tool, said tool having a pair of stems extending therefrom, said stems being adapted to fit snugly within a pair of said holes.

9. A device as defined in claim 2 wherein said body has an additional hole formed therein which opens at said opposite faces for receiving a strap for connecting the device to a golf bag.

* * * * *